US009343805B2

(12) United States Patent
Baan Hofman et al.

(10) Patent No.: US 9,343,805 B2
(45) Date of Patent: May 17, 2016

(54) PRINTED ANTENNA

(71) Applicants: Tyco Electronics Belgium EC BVBA, Oostkamp (BE); Tyco Electronics Nederland BV, S-Hertogenbosch (NL)

(72) Inventors: Martin Baan Hofman, Eindhoven (NL); Yves Braem, Ghent (BE); Dolf Campschroer, Wijchen (NL); Jeroen Dittner, S-Hertogenbosch (NL); Peter Dirk Jaeger, Dussen (NL); Rene Lokker, Druten (NL); Seppo Ojanen, Breugel (NL); John Peetjens, S-Hertogenbosch (NL); Vivian Timmers, Uden (NL); Wijnand Van Gils, Raamsdonksveer (NL)

(73) Assignees: Tyco Electronics Belgium EC BVBA, Oostkamp (BE); TE Connectivity Nederland BV, 'S-Hertogenbosch (NL)

( * ) Notice: Subject to any disclaimer, the term of this patent is extended or adjusted under 35 U.S.C. 154(b) by 172 days.

(21) Appl. No.: 14/150,258

(22) Filed: Jan. 8, 2014

(65) Prior Publication Data

US 2014/0118219 A1 May 1, 2014

Related U.S. Application Data

(63) Continuation of application No. PCT/EP2012/062827, filed on Jul. 2, 2012.

(30) Foreign Application Priority Data

Jul. 8, 2011 (EP) ..... 11173355

(51) Int. Cl.
*H01R 4/24* (2006.01)
*H01Q 1/50* (2006.01)

(Continued)

(52) U.S. Cl.
CPC . *H01Q 1/50* (2013.01); *H01Q 1/38* (2013.01); *H01Q 9/30* (2013.01); *H01R 4/2495* (2013.01);

(Continued)

(58) Field of Classification Search
CPC .... H01Q 1/38; H01R 12/592; H01R 2201/02; H01R 4/2495; Y10T 29/302
USPC ..... 343/700 MS, 906; 29/17.3; 439/422, 439/442
See application file for complete search history.

(56) References Cited

U.S. PATENT DOCUMENTS 4,669,798 A * 6/1987 Daum ..... H01R 12/68 439/423
4,832,620 A * 5/1989 Yamamoto ..... H01R 12/68 439/422

(Continued)

FOREIGN PATENT DOCUMENTS

EP 1691452 A2 8/2006
EP 2375500 A1 10/2011
WO 2007068280 A1 6/2007

OTHER PUBLICATIONS

International Search Report and Written Opinion for International Application No. PCT/EP2012/062827, dated Oct. 25, 2012, 12 pages.

(Continued)

*Primary Examiner* — Tho G Phan
(74) *Attorney, Agent, or Firm* — Barley Snyder

(57) ABSTRACT

An antenna is provided, having a foil sheet, an antenna structure and a connector. The foil sheet includes a front side and a back side, while the antenna structure is printed on the front side using a conductive ink. The antenna structure includes a contact pad. The connector is connected to the contact pad and includes a metallic blade extending through the foil sheet and the contact pad.

20 Claims, 12 Drawing Sheets

(51) Int. Cl.

| | |
|---|---|
| ***H01Q 1/38*** | (2006.01) |
| ***H01Q 9/30*** | (2006.01) |
| ***H01R 13/24*** | (2006.01) |
| ***H01R 12/59*** | (2011.01) |
| ***H01R 43/01*** | (2006.01) |
| *H01R 4/18* | (2006.01) |

(52) U.S. Cl.
CPC ..... *H01R 12/592* (2013.01); *H01R 13/2442* (2013.01); *H01R 13/2478* (2013.01); *H01R 43/01* (2013.01); *H01R 4/182* (2013.01); *H01R 2201/02* (2013.01); *Y10T 29/302* (2015.01)

(56) References Cited

U.S. PATENT DOCUMENTS 5,078,617 A * 1/1992 Gutierrez ..... H01R 4/2466 439/422
5,137,468 A * 8/1992 Murakami ..... H01R 4/2495 439/422
6,203,386 B1 * 3/2001 Checchinato ..... H01R 12/613 439/877
6,565,376 B2 * 5/2003 Aoki ..... H01R 12/68 439/422
7,201,602 B2 4/2007 Kumakura
7,333,061 B2 2/2008 Liu et al.
7,663,561 B2 * 2/2010 Hisaeda ..... B32B 17/10036 343/713
8,021,197 B2 * 9/2011 Milette ..... H01R 13/6466 439/676
2007/0262909 A1 11/2007 Chang et al.
2011/0248892 A1 10/2011 Matsukawa et al.

OTHER PUBLICATIONS

PCT International Preliminary Report on Patentability and Written Opinion of the International Searching Authority for International Application No. PCT/EP2012/062827, dated Jan. 14, 2014, 7 pages.

* cited by examiner

PRINTED ANTENNA

CROSS-REFERENCE TO RELATED APPLICATIONS

This application is a continuation of PCT International Application No. PCT/EP2012/062827 filed Jul. 2, 2012, which claims priority under 35 U.S.C. §119 to EP Patent Application No. 11173355.6 filed Jul. 8, 2011.

FIELD OF THE INVENTION

The present invention relates to an antenna and, more particularly, to a printed antenna.

BACKGROUND

Printed antennas are well known. Conventional printed antennas are manufactured by printing an antenna structure on a carrier using a conductive ink, for example a silver ink. It is known that silver ink starts to oxidize and discolor when exposed to air. Such an oxidation is known to deteriorate the electrical performance of the antenna structure printed with the silver ink. In order to prevent oxidation, it is known to cover the printed antenna structure with a protection layer made of varnish. The varnish layer, however, is also known to deteriorate the electrical performance of the printed antenna. The antenna efficiency of a printed antenna covered with a varnish layer is lower than the antenna efficiency of a printed antenna without a covering varnish layer.

It is further known that conventional printed antennas having an antenna structure printed with a conductive ink possess poor mechanical properties that make it difficult to electrically connect the antenna.

FIG. 14 shows a sectional view of a conventional antenna 20 having a foil sheet 21 with a front side 26 and an opposed back side 27. A printed antenna structure 24 is arranged on the front side 26 of the foil sheet 21. An adhesive strip 22 is arranged on the back side 27 of the foil sheet 21. The adhesive strip 22 is glued to a carrier 23. The printed antenna structure 24 made of conductive ink is not protected by any covering layer.

A saddle shaped connector 25 is arranged between the printed antenna structure 24 and a contact pad arranged on a printed circuit board (PCB) 28. The connector 25 touches the printed antenna structure 24 in a contact point 29. The carrier 23 is pressed towards the connector 25 and the printed circuit board 28 to provide an electrical connection between the printed antenna structure 24 and the printed circuit board 28.

When the antenna 20 of FIG. 14 undergoes a rapid change of temperature, for example a change from −40° C. to +85° C., different coefficients of thermal expansion of the various materials used for the antenna 20 cause the contact point 29 to laterally move over the surface of the printed antenna structure 24. This, combined with the force used to press the carrier 23 towards the connector 25 and the printed circuit board 28 and the specific contact interface shape (radius) of the connector 25 causes damage to the ink layer of the printed antenna structure 24. The conductive ink of the printed antenna structure 24 eventually gets pushed aside, resulting in a poor electrical connection between the connector 25 and the printed antenna structure 24.

SUMMARY

Accordingly, an object of the present invention, among others, is to provide an antenna with improved electrical and mechanical properties.

The antenna includes a foil sheet, an antenna structure and a connector. The foil sheet includes a front side and a back side, while the antenna structure is printed on the front side using a conductive ink. The antenna structure includes a contact pad. The connector is connected to the contact pad and includes a metallic blade extending through the foil sheet and the contact pad.

BRIEF DESCRIPTION OF THE DRAWINGS

The invention will now be explained in more detail with reference to the Figures in which.

DETAILED DESCRIPTION OF THE EMBODIMENT(S)

Figure 1:
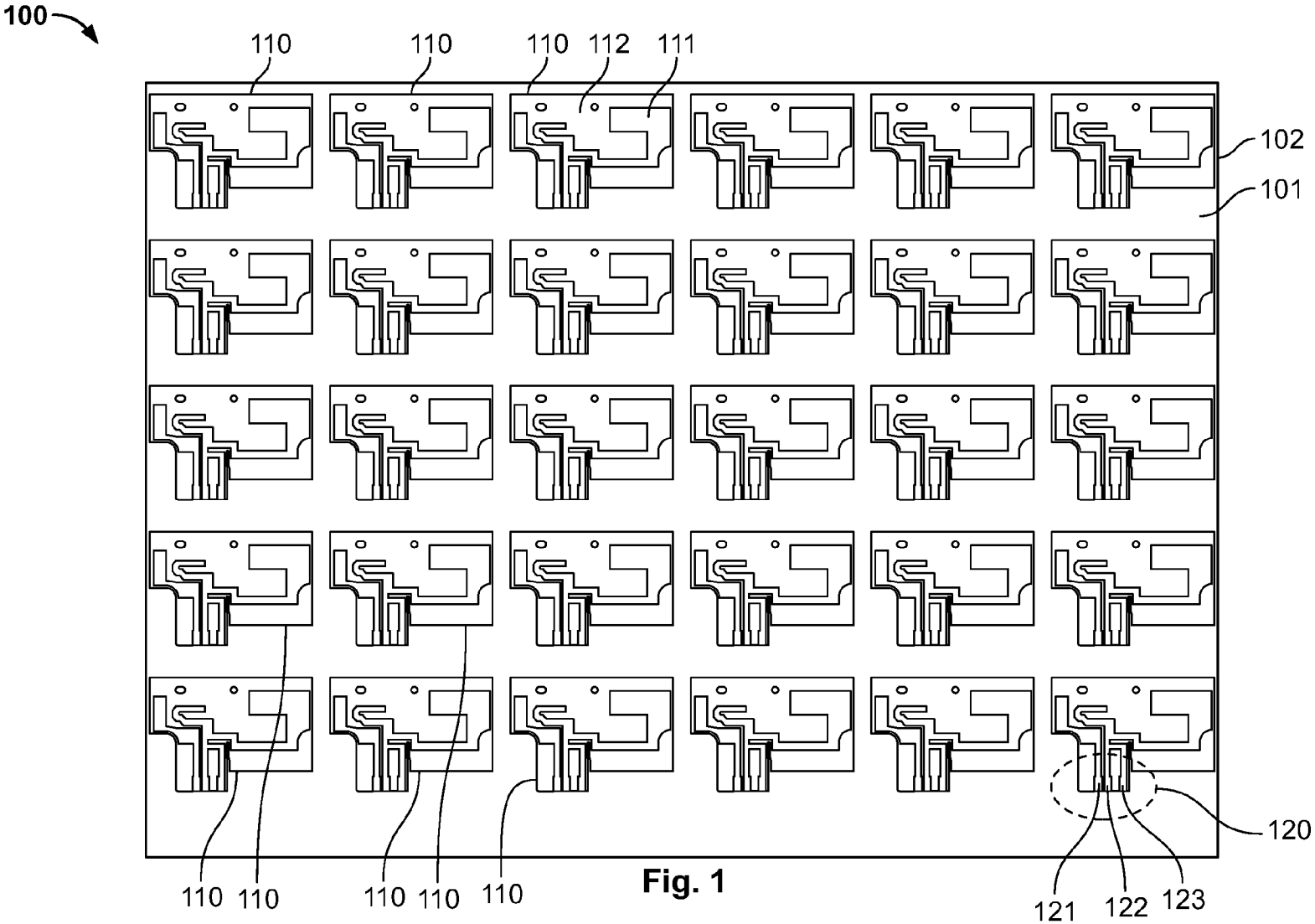
FIG. 1 is a plan view of a foil sheet having a plurality of printed antenna structures according to the invention.

With respect to FIG. 1. a foil sheet 100 is shown, and made of an electrically insulating and flexible material. The foil sheet 100 may for example be a sheet of a flexible plastic foil, preferably a sheet of a polyethylene terephthalate (PET) foil. The foil sheet 100 includes a front side 101 that is visible in FIG. 1. The foil sheet 100 furthermore includes a back side 102 that is opposed to the front side 101.

A plurality of antenna structures 110 are arranged on the front side 101 of the foil sheet 100. The antenna structures 110 are arranged in a regular grid pattern. In the example shown in FIG. 1, the foil sheet 100 includes thirty antenna structures 110 arranged in five rows.

Each of the antenna structures 110 includes an electrically conductive material. The antenna structures 110 are printed on the foil sheet 100 using a silver ink 111 or another sort of conductive ink. The antenna structures 110 may for example be printed on the foil sheet 100 using a screen-printing process.

The geometric layout of the antenna structures 110 depends on the intended application of the antenna structures 110. Methods for designing the geometry of the antenna structures 110 are known in the art. Each antenna structure 110 includes areas in which silver ink 111 is arranged on the foil sheet 100 and blank foil areas 112, in which no silver ink 111 is arranged on the foil sheet 100. The geometric layout of the antenna structures 110 is mirrored with respect to conventional antenna structures according to the state of the art. The reason for mirroring the antenna structures 110 with respect to the prior art will be explained below in the description of FIG. 10.

Each of the antenna structures 110 includes a contact area 120 having a plurality of contact pads. In the example depicted in FIG. 1, each antenna structure 110 includes a first contact pad 121, a second contact pad 122 and a third contact pad 123 arranged in the contact area 120 of the respective antenna structure 110. The antenna structures 110 may, however, includes fewer or more than three contact pads 121, 122, 123.

Figure 2:
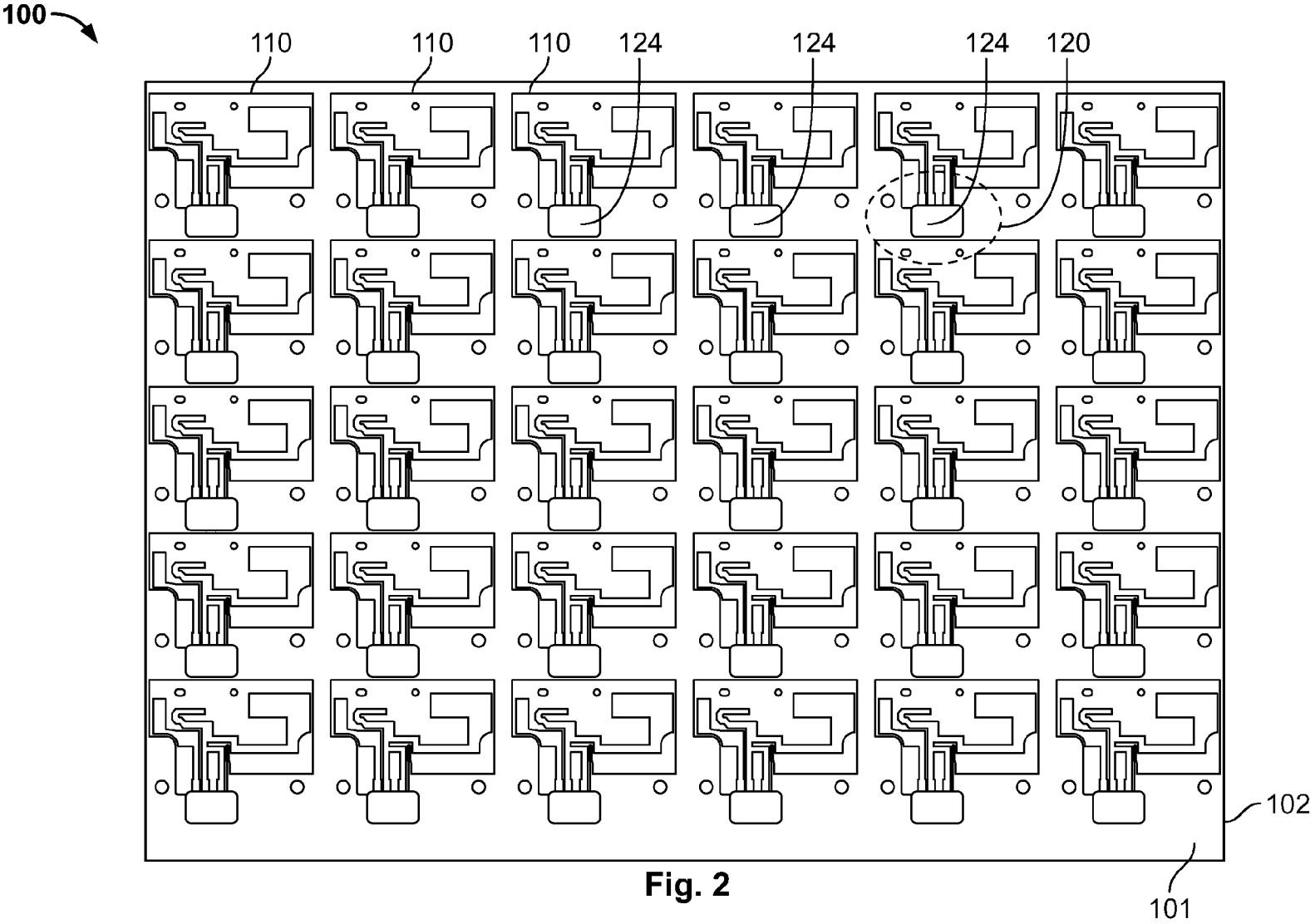
FIG. 2 is a plan view of the foil sheet in FIG. 1 with crimp cutouts created in the foil sheet.

With respect to FIG. 2, the foil sheet 100 is shown after a subsequent process step has been performed. A plurality of crimp cutouts 124 has been created in the vicinity of the contact areas 120 of the antenna structures 110. At each crimp cutout 124, the material of the foil sheet 100 has been removed to form a hole in the foil sheet 100. One crimp cutout 124 is arranged next to the contact area 120 of each antenna structure 110.

Figure 3:
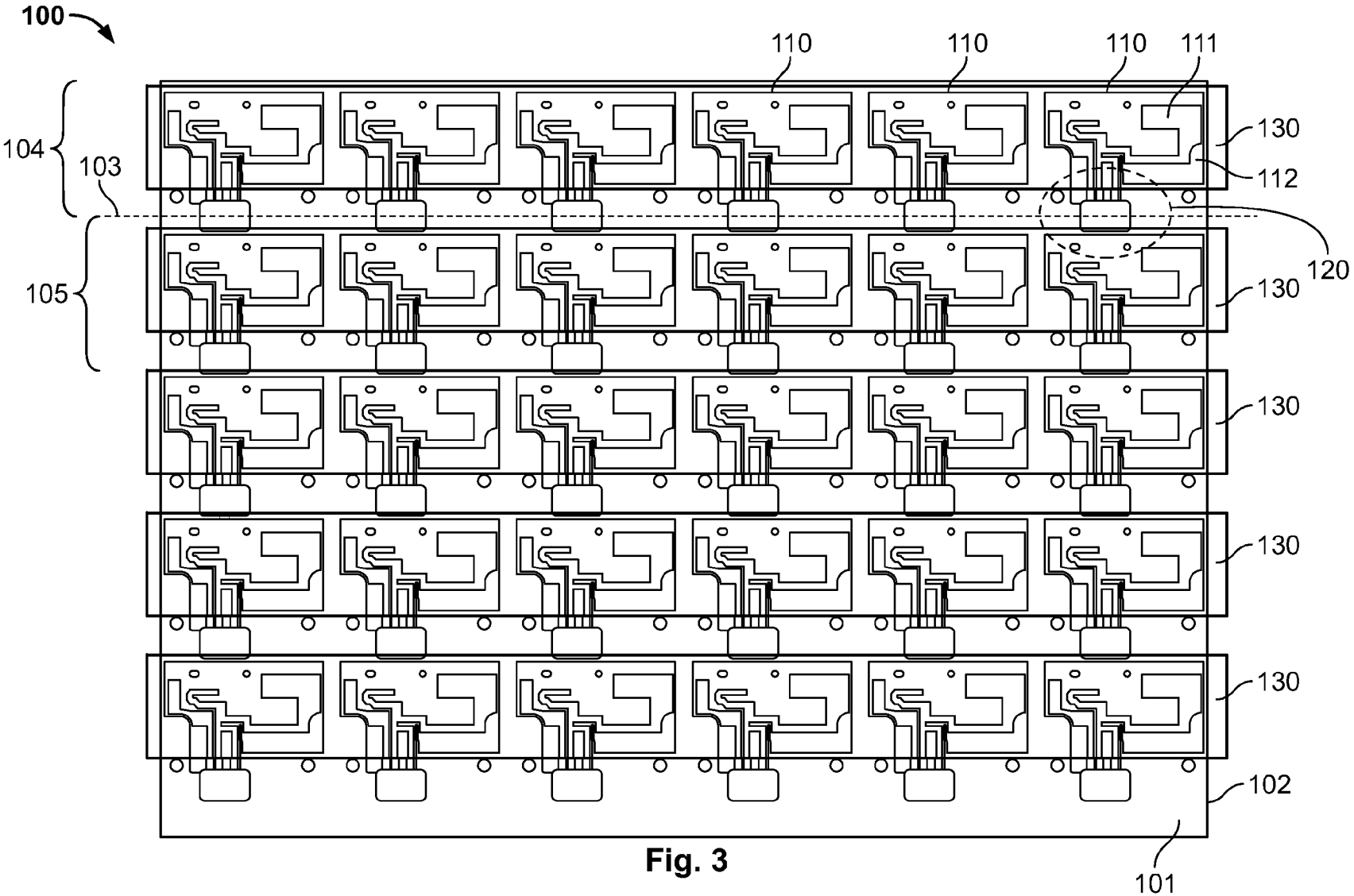
FIG. 3 is a plan view of the foil sheet of FIG. 1 with adhesive strips laminated onto the foil sheet.

FIG. 3 shows the foil sheet 100 after a further subsequent process step has been performed. A plurality of adhesive strips 130 has been fixed, i.e. glued, onto the front side 101 of the foil sheet 100 to partially cover the antenna structures 110 arrange on the front side 101 of the foil sheet 100. Each adhesive strip 130 bends over several antenna structures 110 arranged in one row on the foil sheet 100. In the example shown in FIG. 3, five adhesive strips 130 have been laminated onto the foil sheet 100. In an alternative embodiment, each antenna structure 110 could, however, be covered with a separate adhesive strip 130.

The adhesive strips 130 are double-sided adhesive strips having adhesive material on both sides. The upper side of the adhesive strips 130 may be covered with a liner for protecting the adhesive strips 130 and for preventing dust and dirt from attaching to the upper side of the adhesive strips 130. The liner can be removed from the adhesive strips 130 to expose the upper adhesive side of the adhesive strips 130. The liners are not visible in FIG. 3.

Each antenna structure 110 is completely covered by an adhesive strip 130, except for the contact areas 120 having the contact pads 121, 122, 123. The contact areas 120 having the contact pads 121, 122, 123 are not covered by the adhesive strips 130. The adhesive strips 130 prevent the antenna structures 110 made of silver ink 111 from being exposed to air. Consequently, the adhesive strips 130 protect the antenna structures 110 against oxidation and discoloring. This circumvents a deterioration of the electrical properties of the antenna structures 110.

FIG. 3 further schematically shows a first cutting line 103 along which the foil sheet 100 will be cut in a subsequent process step. The first cutting line 103 runs in parallel to the first row of antenna structures 110 between the first row of antenna structures 110 and the second row of antenna structures 110. The first cutting line 103 crosses the crimp cutouts 124 associated with the antenna structures 110 of the first row of antenna structures 110. Further similar cuts along further cutting lines will be carried out between each of the other rows of antenna structures 110 arranged on the foil sheet 100. These cuts divide the foil sheet 100 into a plurality of foil strips of which a first foil strip 104 and a second foil strip 105 are exemplarily denoted in FIG. 3. Each foil strip 104, 105 includes one row of antenna structures 110. In the example depicted in FIG. 3, each foil strip 104, 105 includes six antenna structures 110.

Figure 4:
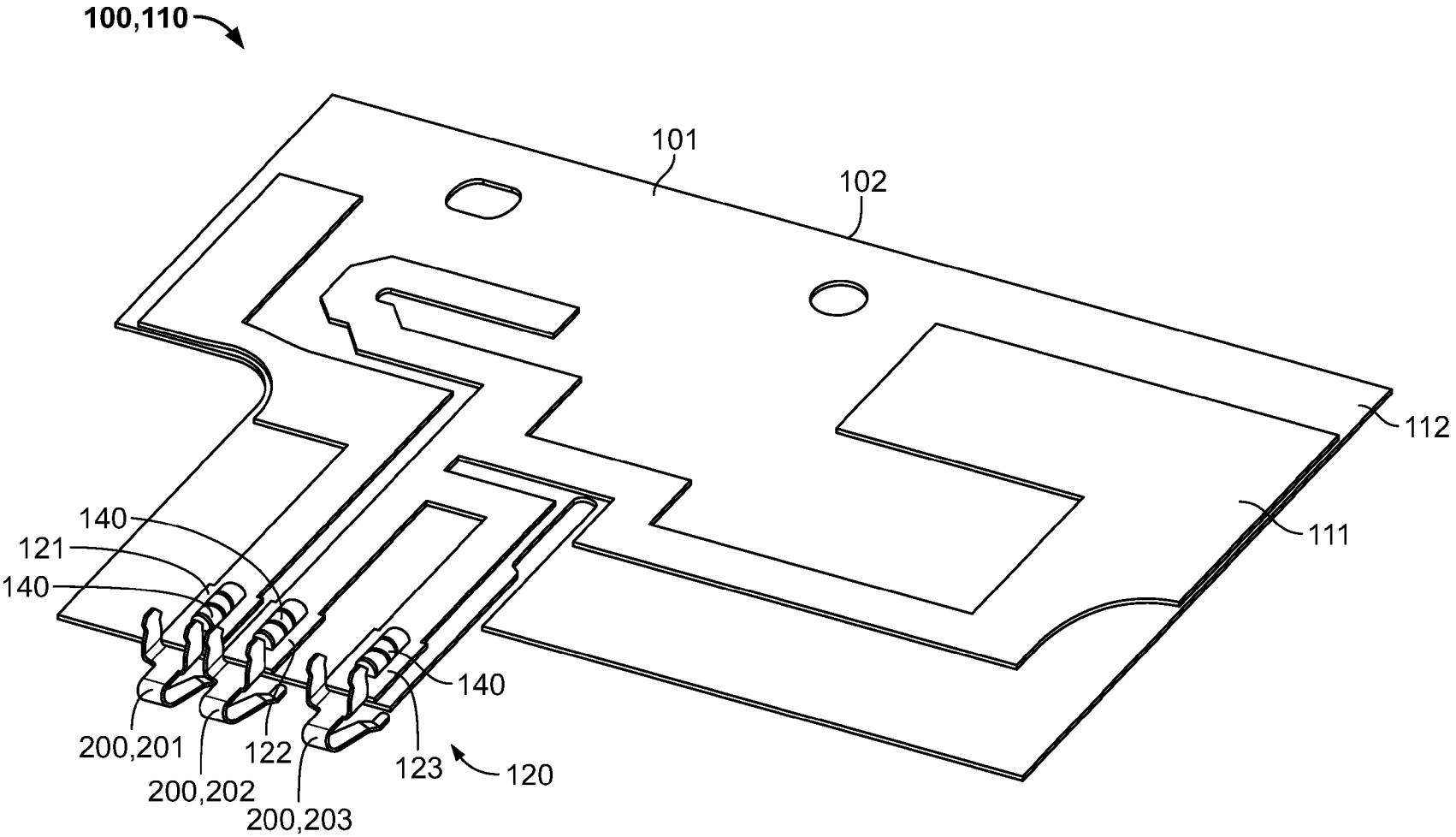
FIG. 4 is a perspective view of a contour-cut foil sheet having an antenna structure and a plurality of connectors according to the invention.

Now with respect to FIG. 4, the foil sheet 100 is shown after two process steps have been performed. First, a plurality of connectors 200 have been connected to the contact pads 121, 122, 123 in the contact area 120 of one antenna structure 110. A first connector 201 has been connected to the first contact pad 121. A second connector 202 has been connected to the second contact pad 122. A third connector 203 has been connected to the third contact pad 123. Connecting the connectors 200 to the contact pads 121, 122, 123 has been facilitated by the crimp cutout 124 that was created in the vicinity of the contact area 120.

After connecting the connectors 200 to the contact pad 121, 122, 123, the antenna structure 110 shown in FIG. 4 has been cut along the contour of the antenna structure 110. Consequently, the antenna structure 110 shown in FIG. 4 is now separated from the other antenna structures 110, shown in FIGS. 1-3.

In the embodiment shown in FIG. 4, the connectors 200 are connected to the contact pads 121, 122, 123 from the back side 102 of the foil sheet 100.

Figure 5:
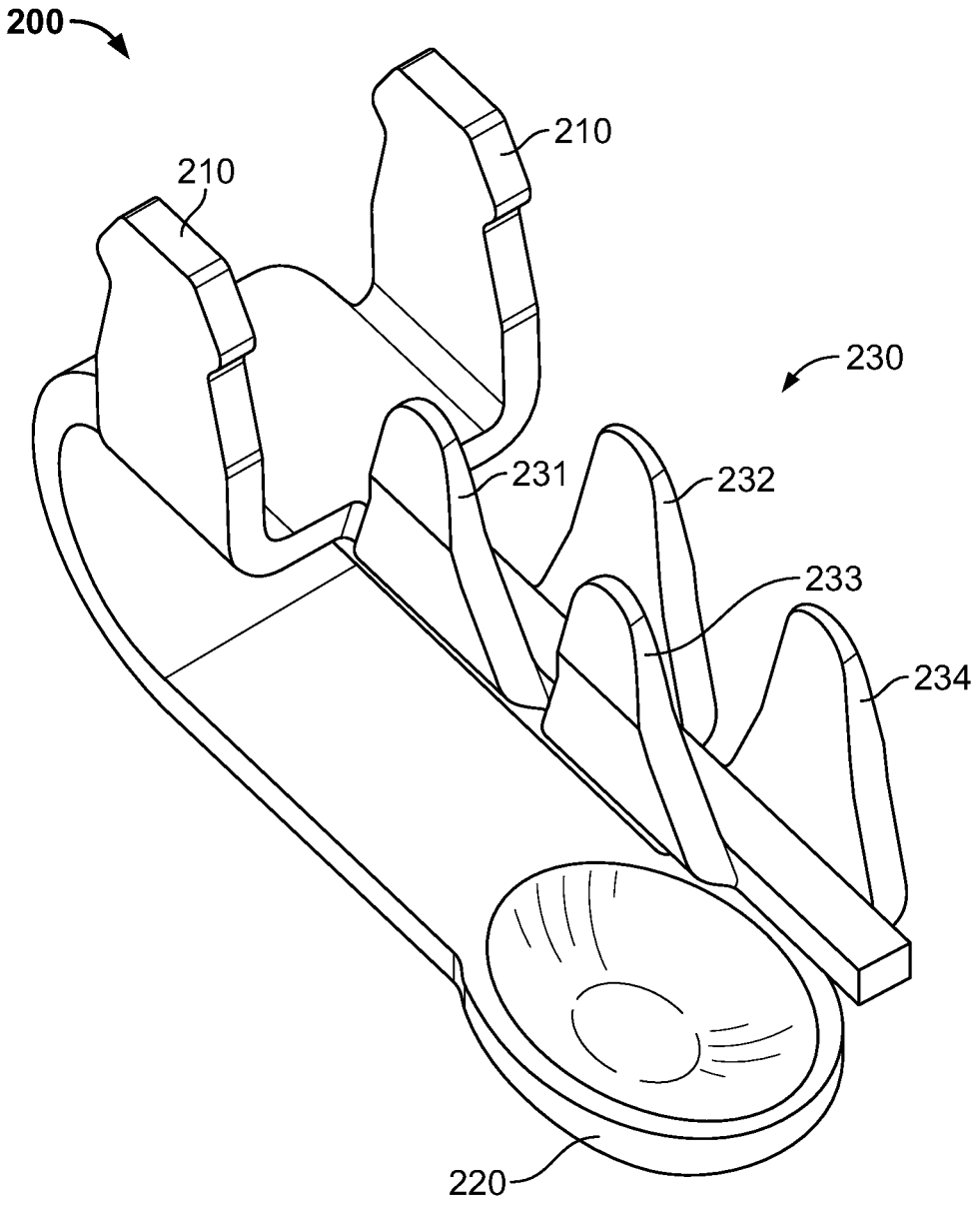
FIG. 5 is a top perspective view of a connector according to the invention.
Figure 6:
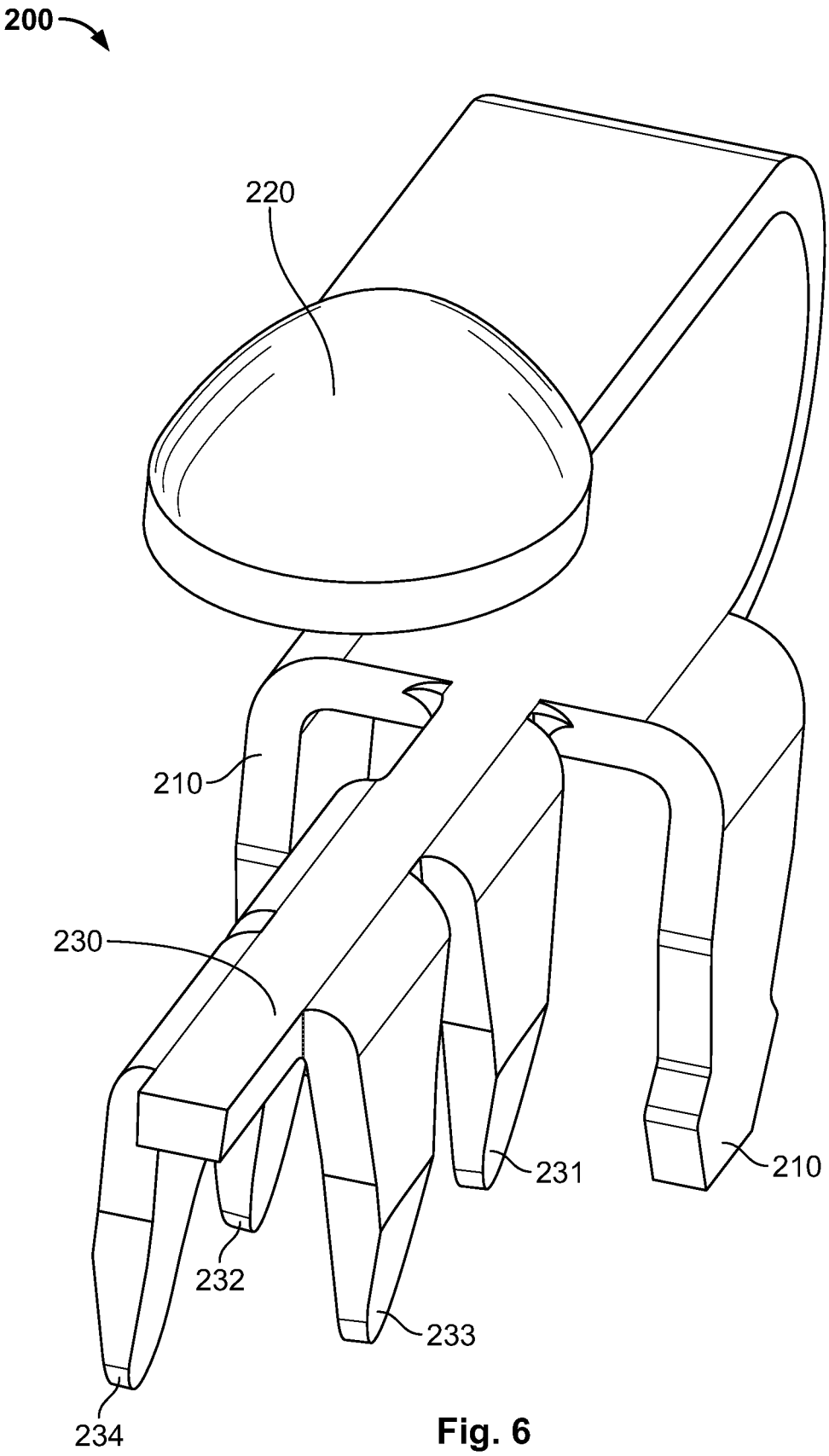
FIG. 6 is a bottom perspective view of the connector of FIG. 5.
Figure 7:
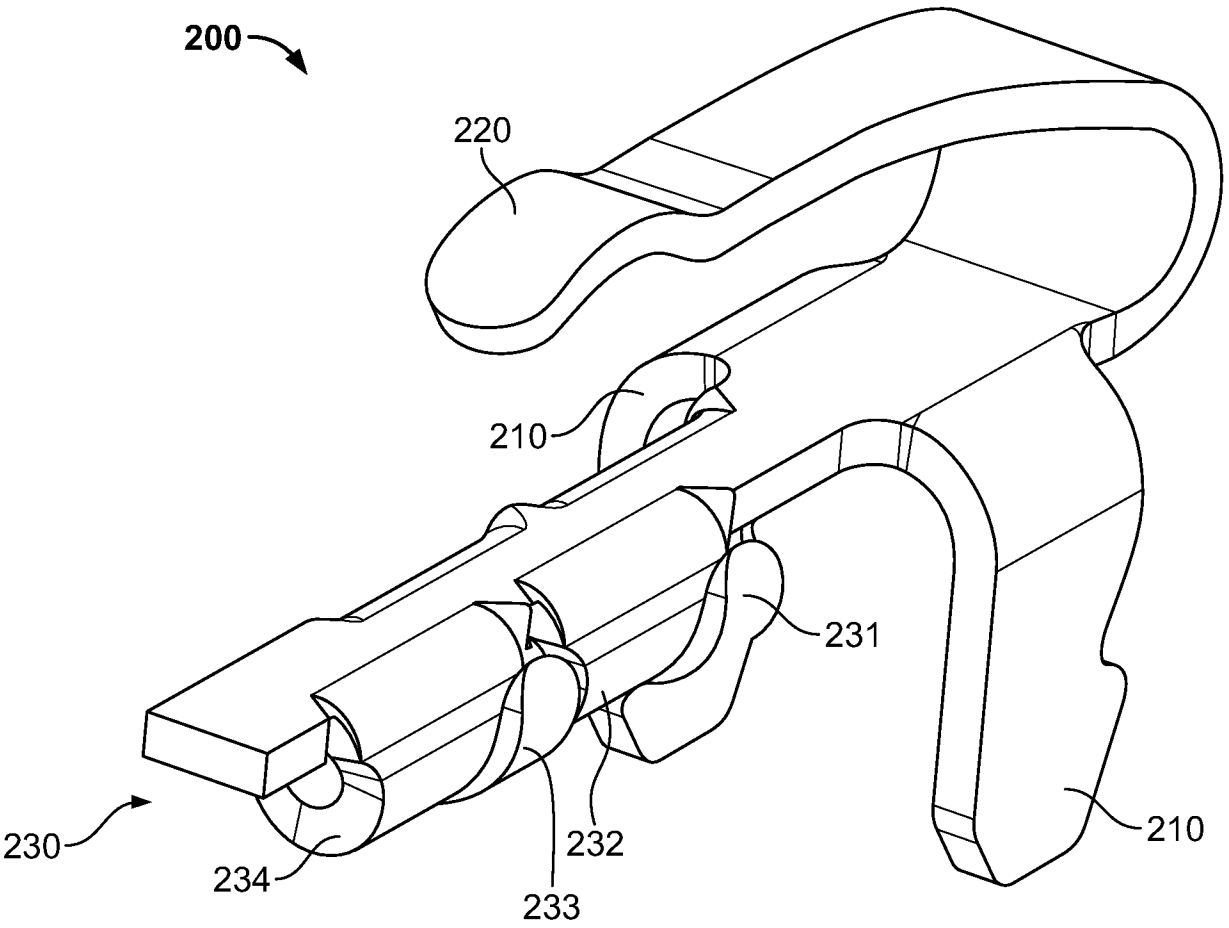
FIG. 7 is a perspective view of another connector according to the invention.

With respect to FIGS. 5, 6 and 7, the connectors 200 are shown, and may be made from an electrically conductive material, such as a metal. It is particular, the connector 200 may be made of plated copper alloy.

The connector 200 includes a basic shape of the letter U. One arm of the U-shaped connector 200 forms a contact spring 220. The other arm of the U-shaped connector 200 comprises a retaining section and a crimp area 230. The retaining section includes two retainers 210 that are arranged in parallel and protrude from the connector 200 in a direction opposed to the contact spring 220. The crimp area 230 includes a first crimp blade 231, a second crimp blade 232, a third crimp blade 233 and a fourth crimp blade 234.

As shown in FIGS. 5 and 6, the crimp blades 231, 232, 233, 234 are in their original configuration, while FIG. 7 shows the crimp blades 231, 232, 233, 234 in a bent or crimped state. In the original configuration shown in FIGS. 5 and 6, the crimp blades 231, 232, 233, 234 each point in the same direction as the retainers 210. The first crimp blade 231 and the third crimp blade 233 are arranged on one side of the crimp area 230. The second crimp blade 232 and the fourth crimp blade 234 are arranged on the other side of the crimp area 230. FIG. 7 shows that the crimp blades 231, 232, 233, 234 can be bent in such a way that the crimp blades 231, 232, 233, 234 engage with each other. The first crimp blade 231 and the third crimp blade 233 are bent towards the second crimp blade 232 and the fourth crimp blade 234. The second crimp blade 232 and the fourth crimp blade 234 are bent towards the first crimp blade 231 and the third crimp blade 233.

It is possible to design the connector 200 differently. The connector 200 may comprise fewer or more than four crimp blades 231, 232, 233, 234. The retainers 210 and the contact spring 220 may also be developed in other ways than shown in FIGS. 5 to 7.

The first connector 201, the second connector 202 and the third connector 203 connected to the contact area 120 shown in FIG. 4 were initially configured as the connector 200 shown in FIGS. 5 and 6. The crimp blades 231, 232, 233, 234 of the connectors 201, 202, 203 have been pierced through the foil sheet 100 and the contact pads 121, 122, 123, respectively, from the back side 102 of the foil sheet 100 to the front side 101 of the foil sheet 100. Afterwards, the crimp blades 231, 232, 233, 234 of the connectors 201, 202, 203 have been bent or crimped on the front side 101 of the foil sheet 100 as previously described to form crimp connections 140 that improve the electrical connections between the contact pads 121, 122, 123 and the connectors 201, 202, 203, respectively, and that fixate the connectors 201, 202, 203 on the foil sheet 100. Consequently, the first connector 201 is electrically connected to the first contact pad 121. The second connector 202 is electrically connected to the second contact pad 122. The third connector 203 is electrically connected to the third contact pad 123. The crimp connections 140 between the connectors 201, 202, 304 and the contact pads 121, 122, 123 posses reproducible contact resistances that do not deteriorate strongly over time or when exposed to physical stress.

Figure 8:
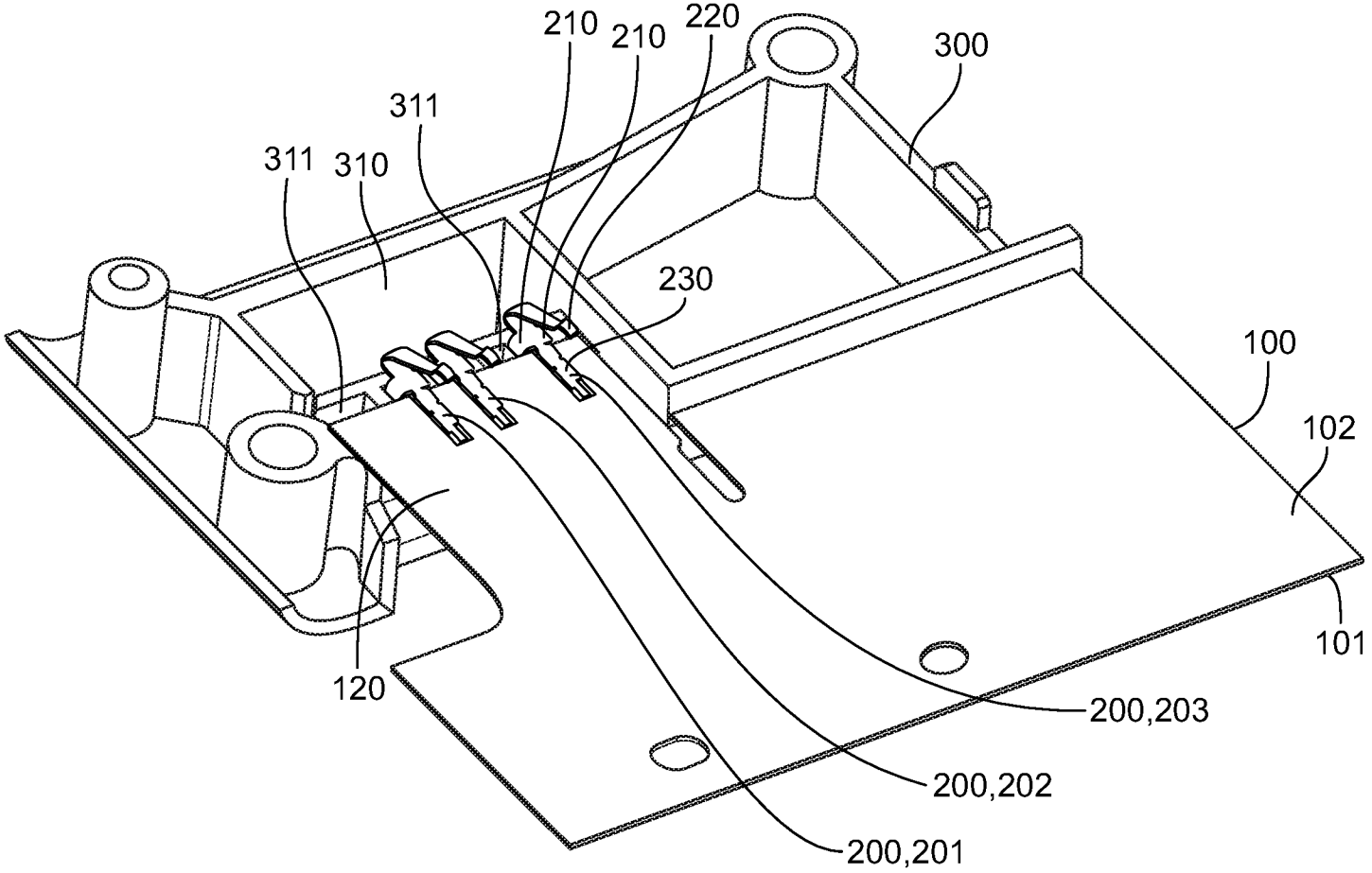
FIG. 8 is a perspective view of a foil sheet having an antenna structure and a carrier according to the invention.

FIG. 8 shows the foil sheet 100 having the antenna structure 110 after a further process step has been carried out, as well as a carrier 300. The carrier 300 includes an electrically insulating material. The carrier 300 may for example be made of a plastic material. The carrier 300 includes a contact section 310, and a plurality of retainer receiving passageways 311 arranged in the contact section 310. Each retainer receiving passageway 311 is designed in such a way that it can receive the retainers 210 of one connector 200.

The retainers 210 of the first connector 201 are arranged in a first retainer receiving passageway 311 of the carrier 300. The retainers 210 of the second connector 202 and the retainers 210 of the third connector 203 are accordingly arranged in retainer receiving passageways 311 of the carrier 300. The retainers 210 arranged in the passageways 311 retain the connectors 201, 202, 203 on the carrier 300.

The arrangement of the contact area 120 of the antenna structure 110 in the contact section 310 mechanically protects the connectors 201, 202, 203 and the crimp connections 140 in the contact area 120. If an additional protection is required, an electrically insulating potting compound could be arranged on the crimp connections 140 in the contact area 120 on the front side 101 of the foil sheet 100 before arranging the contact area 120 in the contact section 310 of the carrier 300. Alternatively, an adhesive could be arranged on the crimp connections 140 on the front side 101 of the foil sheet 100 before arranging the contact area 120 in the contact section 310 of the carrier 300. The adhesive could also be arranged in the contact section 310 of the carrier 300 before arranging the contact area 120 with the crimp connections 140 in the contact section 310 of the carrier 300. As a further alternative, a second PET layer could be arranged on top of the front side 101 of the foil sheet 100 and the contact area 120 to protect the crimp connections 140.

The front side 101 of the foil sheet 100 is oriented towards the carrier 300. The back side 102 of the foil sheet 100 points away from the carrier 300.

Figure 9:
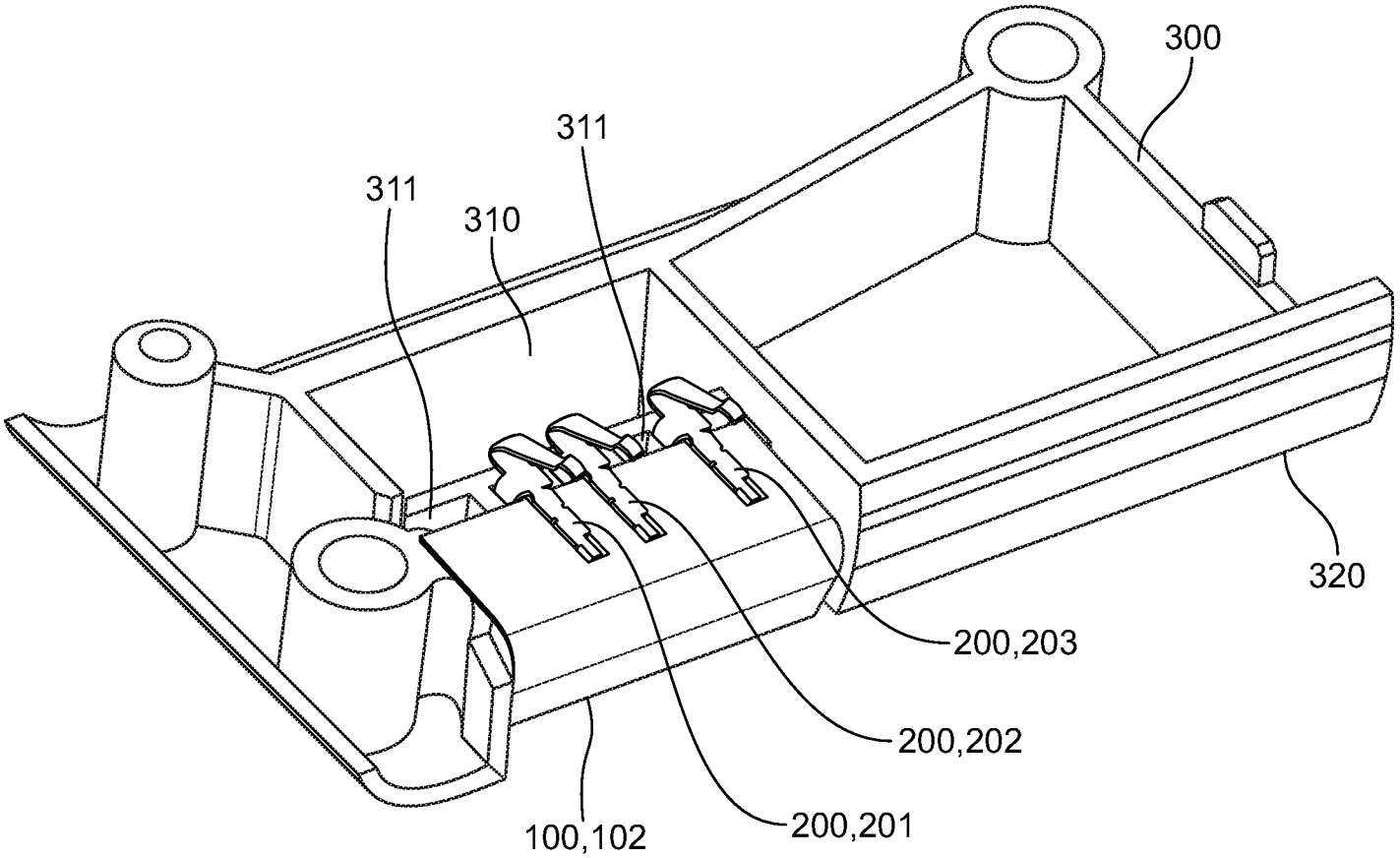
FIG. 9 is a perspective view of the foil sheet of FIG. 8 fixed glued onto the carrier.

FIG. 9 depicts the carrier 300 and the foil sheet 100 after a further process step has been carried out, with the carrier 300 having a smooth surface 320 arranged on a side of the carrier 300 that is opposed to the contact section 310.

In the process step carried out between the depictions of FIG. 8 and FIG. 9, a liner arranged on the adhesive strip 130 arranged on the antenna structure 110 on the front side 101 of the foil sheet 100 has been removed. The foil sheet 100 has then been bent around the carrier 300 and glued on the smooth surface 320 by means of the adhesive strip 130.

Since the adhesive strip 130 is arranged on the front side 101 of the foil sheet 100, the front side 101 of the foil sheet 100 is now oriented towards the carrier 300. The antenna structure 110 arranged on the front side 101 of the foil sheet 100 is located between the smooth surface of the carrier 300 and the foil sheet 100. Advantageously, this protects the antenna structure 110 made of silver ink 111 from oxidation, discoloring and mechanical damage.

Figure 10:
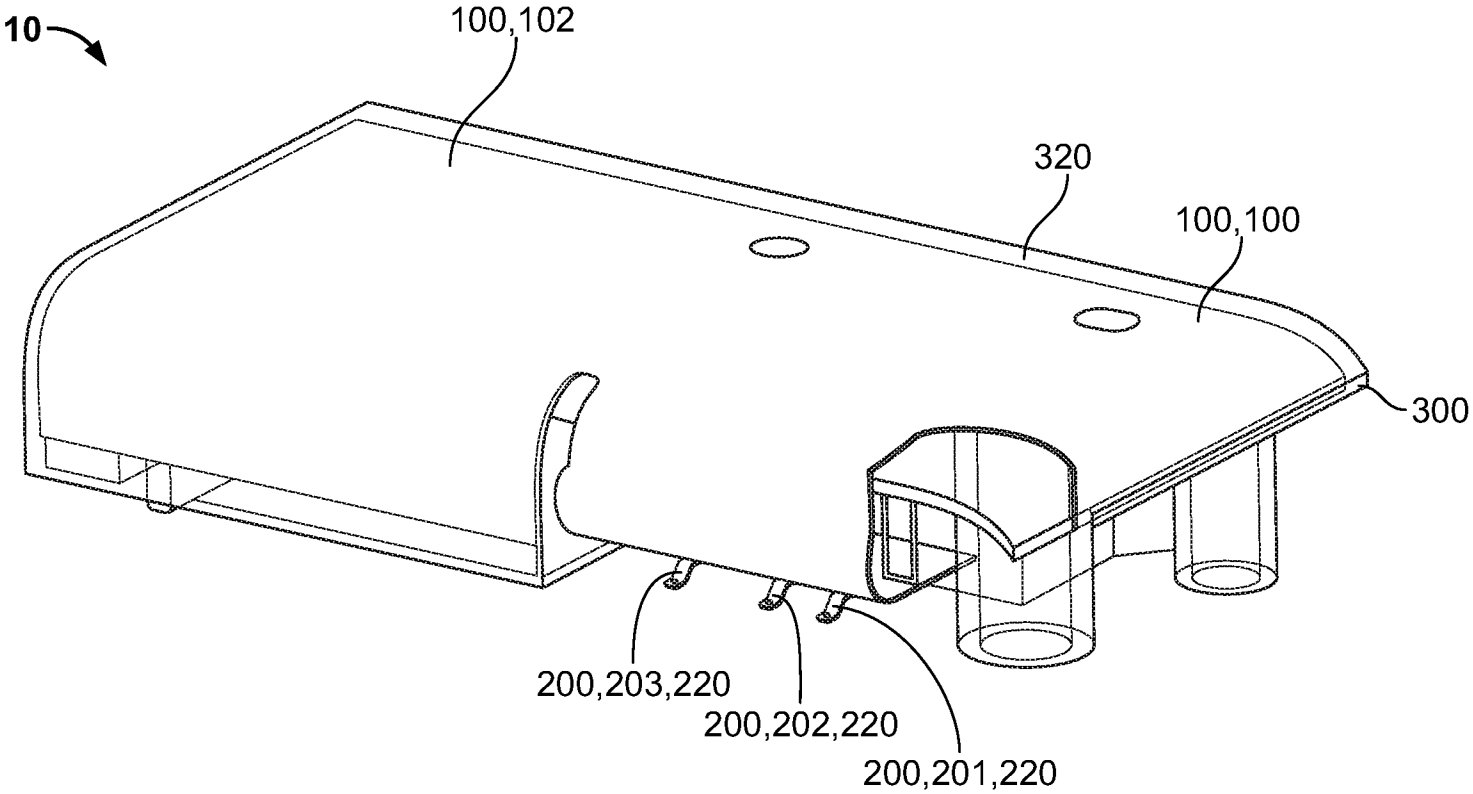
FIG. 10 is a perspective view an assembled antenna according to the invention.

FIG. 10 shows a final antenna 10 according to the invention that includes the carrier 300 and the foil sheet 100 having the antenna structure 110 glued onto the smooth surface 320 of the carrier 300. The antenna structure 110 is arranged on the front side 101 of the foil sheet 100 that faces the smooth surface 320 of the carrier 300. For this reason, the geometric layout of the antenna structure 110 shown in FIG. 4 has been mirrored with respect to the geometric layout of an antenna structure according to the state of the art.

The contact springs 220 of the connectors 201, 202, 203 connected to the contact pads 121, 122, 123 are accessible in the contact section 310 of the carrier 300. The contact springs 220 may be electrically contacted to connect to the antenna structure 110 of the antenna 10.

FIGS. 11 and 12 again illustrate a crimp connection 140 between a connector 200 and a contact pad 121, 122, 123 in a contact area 120 of an antenna structure 110 on the front side 101 of a foil sheet 100.

Figure 11:
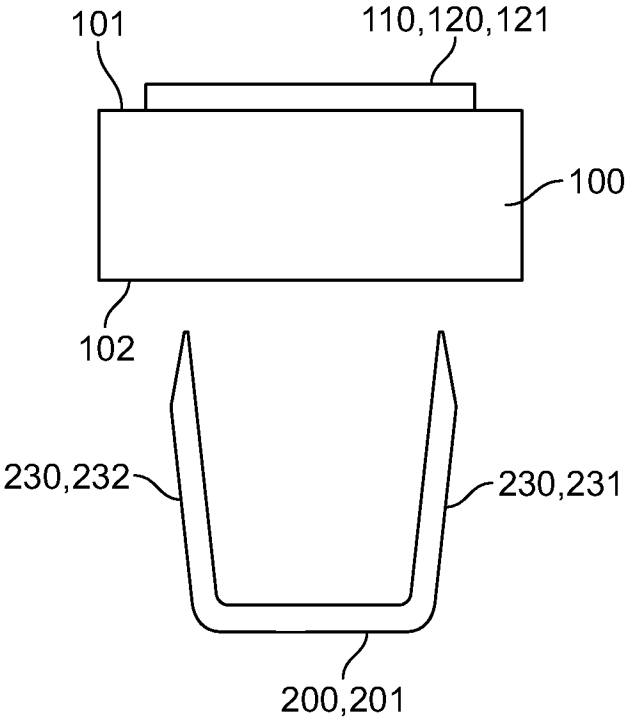
FIG. 11 is a schematic illustration of a first method of creating a crimp connection.

FIG. 11 shows the embodiment described in conjunction with FIG. 4 above. The crimp blades 231, 232, 233, 234 of the connector 200 are pierced through the foil sheet 100 from the back side 102 of the foil sheet 100 to the front side 101 of the foil sheet 100. Afterwards, the crimp blades 231, 232, 233, 234 of the connector 200 are bent over at the front side 101 of the foil sheet 100 to form the crimp connection 140 on the front side 101 of the foil sheet 100.

Figure 12:
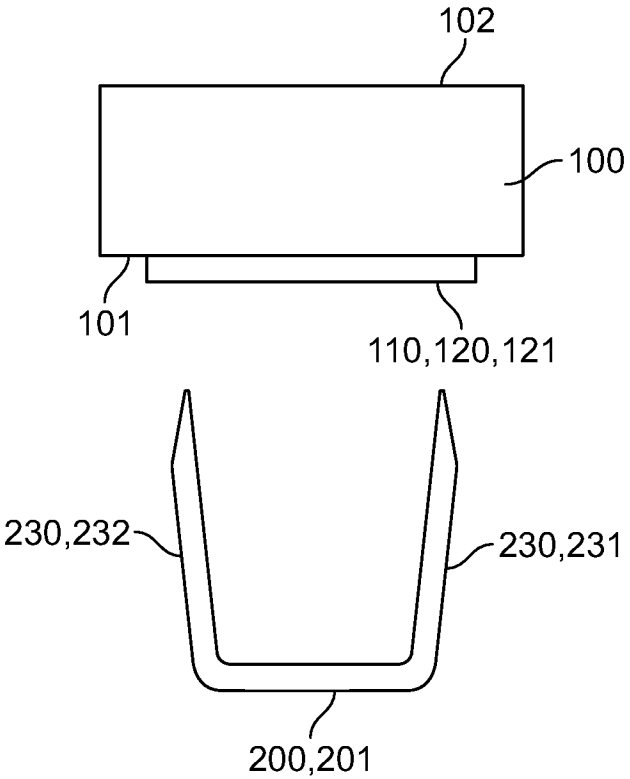
FIG. 12 is a schematic illustration of a second method of creating a crimp connection.

FIG. 12 shows an alternative embodiment. In the shown embodiment, the crimp blades 231, 232, 233, 234 of the connector 200 are pierced through the foil sheet 100 from the front side 101 of the foil sheet 100 to the back side 102 of the foil sheet 100. Afterwards, the crimp blades 231, 232, 233, 234 of the connector 200 are bent over at the back side 102 of the foil sheet 100 to form the crimp connection 140 on the back side 102 of the foil sheet 100.

In the shown embodiment, a potting compound or an adhesive or a second PET layer to protect the crimp connection 140 will be arranged on the back side 102 of the foil sheet 100.

In the shown embodiment, the connector 200 may be designed as explained in the description of FIGS. 5 to 7. The connector 200 may, however, also be designed differently. The crimp blades 231, 232, 233, 234 of the connector 200 may for example be oriented towards the contact spring 220.

Figure 13:
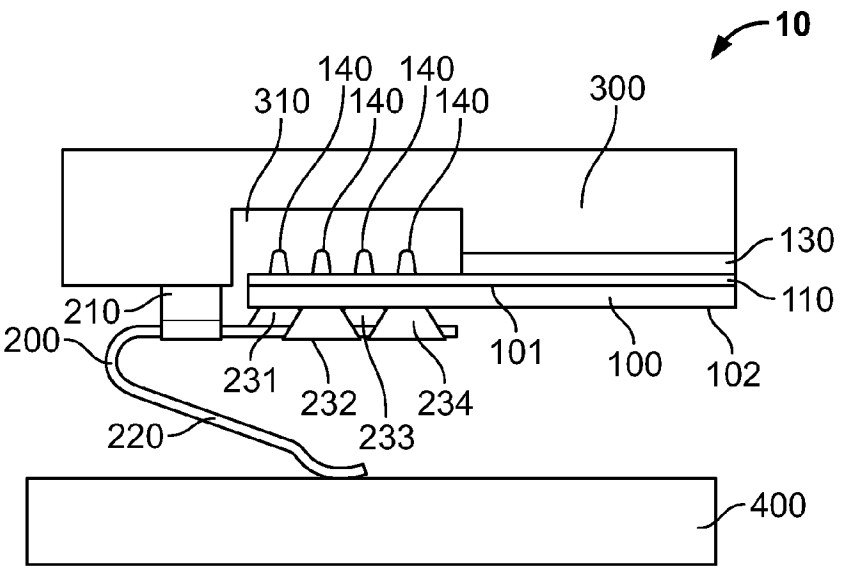
FIG. 13 is a sectional view of an assembled antenna according to the invention.

Now with respect to FIG. 13, as assembled antenna 10 is shown. The crimp blades 231, 232, 233, 234 of the connector 200 are pierced through the foil sheet 100 from the back side 102 of the foil sheet 100 to the front side 101 of the foil sheet 100 and bent over at the front side 101 of the foil sheet 100 to form the crimp connection 140. The contact spring 220 of the connector is pressed against a contact pad arranged on a printed circuit board (PCB) 400.

Figure 14:
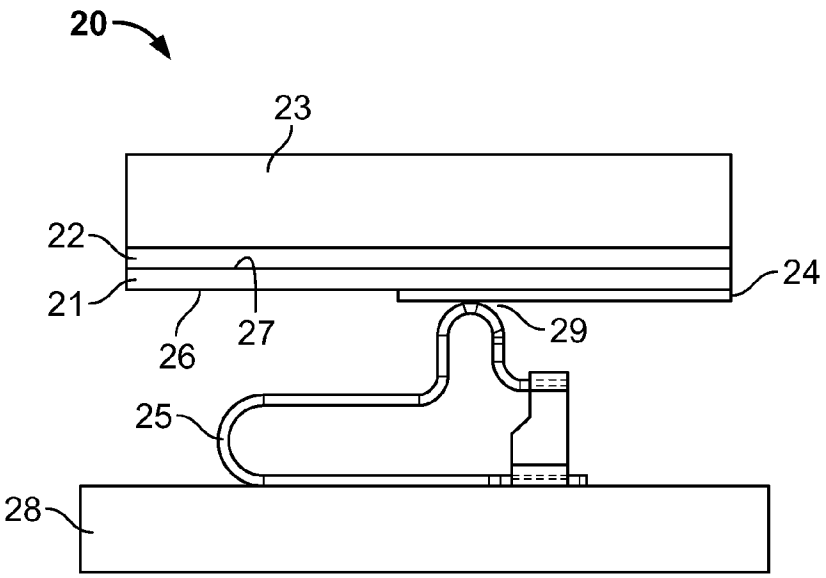
Fig. 14 Prior Art
FIG. 14 is a sectional view of a conventional antenna.

When compared to the convention antenna 20 of FIG. 14, the antenna 10 of FIG. 13 ensures a stable connection between the antenna structure 110 and the connector 200 even after rapid changes of temperature. Extensive tests have shown that thermal stress and other stress exerted on the antenna 10 will not increase an electrical resistance between a contact pad 121, 122, 123 of the antenna 10 and a connector 200 by more than a factor of two.

Although several embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An antenna, comprising:

a foil sheet having a front side and a back side;

an antenna structure printed on the front side using a conductive ink and having a contact pad;

a connector connected to the contact pad and having a metallic blade extending through the foil sheet and the contact pad; and an adhesive strip laminated onto the antenna structure on the front side.

2. The antenna of claim 1, wherein the metallic blade extends from the back side to the front side.

3. The antenna of claim 2, wherein the metallic blade bends over the front side to form a crimp connection.

4. The antenna of claim 3, further comprising a potting compound arranged on the crimp connection.

5. The antenna as claimed in claim 3, further comprising an adhesive material arranged on the crimp connection.

6. The antenna of claim 1, further comprising an insulating carrier fixed to the front side using an adhesive strip.

7. The antenna of claim 6, wherein the insulating carrier includes a retainer receiving passageway.

8. The antenna of claim 7, wherein the connector is partially arranged in the retainer receiving passageway.

9. The antenna of claim 1, wherein the foil sheet is a PET foil sheet.

10. The antenna of claim 1, wherein the conductive ink is a silver ink.

11. A method for producing an antenna, comprising the following steps:

providing a foil sheet having a front side and a back side;

printing a conductive antenna structure on the front side using a conductive ink and having a contact pad;

laminating an adhesive strip onto the antenna structure along the front side; and piercing a metallic blade from a connector through the foil sheet and the contact pad.

12. The method according to claim 11, wherein the metallic blade extends from the back side to the front side.

13. The method according to claim 12, further comprising the following step:

bending over the metallic blade at the front side to form a crimp connection.

14. The method according to claim 13, further comprising the following step:

fixing the front side onto an insulating carrier using adhesive strip.

15. The method according to claim 14, further comprising the following step:

cutting the foil sheet along a contour of the antenna structure.

16. An antenna, comprising:

a foil sheet having a front side and a back side;

an antenna structure printed on the front side using a conductive ink and having a contact pad; and a connector having a first end and a second end, wherein the first end of the connector is connected to the contact pad and has a metallic blade extending through the foil sheet and the contact pad, and the second end of the connector forms a contact spring.

17. The antenna of claim 16, wherein the metallic blade extends from the back side to the front side.

18. The antenna of claim 17, wherein the metallic blade bends over the front side to form a crimp connection.

19. The antenna of claim 18, further comprising a potting compound arranged on the crimp connection.

20. The antenna of claim 16, further comprising an adhesive strip laminated onto the antenna structure on the front side.

* * * * *